US006363894B1

(12) United States Patent
Barkman

(10) Patent No.: US 6,363,894 B1
(45) Date of Patent: Apr. 2, 2002

(54) DIESEL ENGINE HAVING A CYLINDER LINER WITH IMPROVED COOLING CHARACTERISTICS

(75) Inventor: Dick Allen Barkman, Royal Oak, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/735,865

(22) Filed: Dec. 14, 2000

(51) Int. Cl.[7] ..... F02F 1/10
(52) U.S. Cl. ..... 123/41.84; 123/41.79
(58) Field of Search ..... 123/41.79, 41.83, 123/41.84

(56) References Cited

U.S. PATENT DOCUMENTS 5,596,954 A * 1/1997 Kennedy ..... 123/41.84

* cited by examiner

*Primary Examiner*—Noah P. Kamen
(74) *Attorney, Agent, or Firm*—Bill C. Panagos

(57) ABSTRACT

An internal combustion engine including a cylinder block having at least one cylinder bore and a cylinder liner concentrically disposed within the cylinder bore and secured to the cylinder block. The cylinder liner includes a main body portion and an upper margin. A main cooling chamber surrounds a substantial portion of the main body portion of the cylinder liner and has an inlet port and at least one outlet port for circulating a coolant fluid about the main body portion of the cylinder liner. A secondary cooling chamber is located about the circumference of the upper margin of the cylinder liner. The secondary cooling chamber has four inlet ports in fluid communication with the main cooling chamber and disposed space from one another at equidistant points about the circumference of the cylinder liner. Furthermore, the secondary cooling chamber includes four outlet ports providing fluid communication with the outlet port of the main cooling chamber. The four outlet ports are located spaced from one another at equidistant points about the circumference of the cylinder liner and between adjacent ones of the inlet ports. The secondary cooling chamber further includes eight discreet segments extending between the four inlet ports and the four outlet ports such that fluid coolant is circulated from each of the four inlet ports in opposite directions through adjacent segments of the secondary cooling chamber toward a pair of the four outlets.

5 Claims, 4 Drawing Sheets

DIESEL ENGINE HAVING A CYLINDER LINER WITH IMPROVED COOLING CHARACTERISTICS

BACKGROUND OF THE INVENTION

1. Field of the Invention

This invention relates to internal combustion engines, in general, and particularly to fuel injected diesel cycle engines. More specifically, the present invention relates to the construction of the cylinder block and cylinder liner to accommodate cooling of the liner.

2. Description of the Related Art

It is conventional practice to provide the cylinder block of an internal combustion engine with numerous cast-in-place, interconnected coolant passages within the area of the cylinder bore. Coolant fluid is circulated through these passages to maintain the engine block temperature at a predetermined acceptably low range, thereby precluding excessive heat distortion of the piston cylinder, and related undesirable interference between the piston assembly and the piston cylinder.

However, in conventional diesel engines having replaceable cylinder liners of the flange-type, coolant is generally not in contact with the upper margin or top portion of the liner, but rather is restricted to contact below the support flange in the cylinder block. This support flange is normally, and necessarily, of substantial thickness. The upper margin of the cylinder liner spans the area of the combustion chamber defined by the piston and the cylinder. Thus, the upper margin is the most highly heated portion of the cylinder liner and is not directly cooled.

Furthermore, uniform cooling all around the liner is difficult to achieve near the top, or upper margin, of the liner because the location of coolant transfer holes in the cylinder head is often restricted by other, overriding design considerations. The number of transfer holes is usually limited, and in many engine designs, the transfer holes are not uniformly spaced.

All of the foregoing has been conventional practice in internal combustion engines, and particularly with diesel cycle engines, for many years. However, in recent years there has been a great demand for increasing the horsepower output of the engine package. At the same time, there also exists demands to redesign certain engine components in an effort to improve emissions by lowering hydrocarbon content. Both of these demands result in hotter running engines, which in turn create greater demands on the cooling system.

As noted above, the most critical area of the cylinder liner spans the upper margin, and includes the top piston ring reversal point. The top piston ring reversal point is the top dead center position of the piston and is a point at which the piston is at dead stop or zero velocity. In commercial diesel engine operations, it is believed that the temperature at this piston reversal point must be maintained so as not to exceed 400° F. (200° C.). However, in meeting the demands for more power and fewer hydrocarbon emissions, the fuel injection pressure in a diesel cycle engine has been increased on the order of over 40% (from 20,000 psi to a range including 28,000–32,000 psi) and the engine timing has been retarded.

Collectively, these operating parameters make it difficult to maintain an acceptable piston cylinder liner temperature at its upper margin and corresponding to the top piston ring reversal point with the conventional cooling techniques described above. More specifically, and where no means for cooling the upper margin of the cylinder liner has been provided in the related art, a certain zone in the main cooling chamber approximately 90 degrees spaced from a given outlet has a tendency to be an area of stagnation with little or no coolant flow. Consequently, this zone was susceptible to producing hot spots on the liner. When cylinder liner temperatures exceed acceptable levels, coolant fluid can boil which increases its thermal loading and can lead to distortions and even scuffing of the cylinder liner. FIG. 6 graphically illustrates this point. Here, the temperature of the coolant and the cylinder liner (TLC) are presented as a function of coolant mass flow rate. The ability of the coolant to function decreases as it exceeds its boiling limit which, in turn, causes the temperature of the cylinder liner to increase, thereby increasing the risk of cylinder liner scuffing. Thus, in general, as operating temperatures in the combustion chamber have increased, so have the risk of cylinder liner scuffing failures due to inadequate cooling.

Attempts have been made in the past to address this issue. For example, U.S. Pat. No. 5,596,954 issued on Jan. 28, 1997; U.S. Pat. No. 5,505,167 issued on Apr. 9, 1996; and U.S. Pat. No. 5,299,538 which issued on Apr. 5, 1994 each disclose internal combustion engines having cylinder liners which are designed to improve coolant flow about the upper margins of the liners. Each of these patents is assigned to the assignee of the present invention and their disclosures are incorporated herein by reference. While the cylinder liners and methods of cooling the liners disclosed in these patents represent significant improvements over the liners and methods known in the related art, as the operating temperatures and pressures of the internal combustion engines continue to increase, there has remained a need to find additional ways to reduce the thermal loading on coolant fluid thereby maintaining the temperature of the cylinder liner within acceptable ranges.

Recently, it has also been determined that variation in liner temperature from cylinder to cylinder in a given engine block is a function of coolant mass flow distribution in the cylinder head. More specifically, FIG. 7 illustrates the effect of exhaust gas temperature on coolant temperature for cylinder liners known in the related art. The position or height of the curve relative to the y-axis depends on engine load and injection timing (i.e. gas temperature), and the coolant mass flow rate, which, in turn depends upon engine pump speed. Together, these parameters determine the operating point on the curve. At a given engine speed and constant mass flow represented by the vertical line at 0.015 kg/s in FIG. 7, the coolant temperature will be determined by where the mass flow line intersects the operating curve. If the lower curve represents peak torque operation at ratings known in the related art (reference gas temperature), and the upper curve represents projected peak torque operation at future high torque ratings (high gas temperature), then the coolant temperature will increase from below boiling to above boiling due to the torque rating increase. Thus, it is projected that in order to maintain coolant temperatures below the boiling point using known cylinder liner coolant designs, the mass flow of the coolant must be increased until the operating point on the top curve moves below the coolant boiling limit. In turn, this requires increased pump capacity or an alternative cylinder liner coolant design adapted to handle the higher temperatures induced at the higher engine operating parameters. While a high flow pump is one method of increasing the coolant mass flow rate, this approach suffers from the disadvantage that it increases parasitic losses for the engine.

Thus, there remains a need in the art for a cylinder liner which facilitates adequate cooling via increased coolant mass flow which is sufficient to accommodate the ever-increasing operating temperatures in internal combustion engines and, particularly, those using the diesel engine cycle.

SUMMARY OF THE INVENTION

The present invention overcomes the deficiencies in the related art in an internal combustion engine including a cylinder block having at least one cylinder bore. The internal combustion engine includes a cylinder liner which is concentrically disposed within the cylinder bore and secured to the cylinder block. The cylinder liner includes a main body portion and an upper margin thereof. A main cooling chamber surrounds a substantial portion of the main body portion of the cylinder liner and has an inlet port and at least one outlet port for circulating a coolant fluid about the main body portion of the cylinder liner. Furthermore, the cylinder liner includes a secondary cooling chamber located about the circumference of the upper margin of the cylinder liner. The secondary cooling chamber includes four inlet ports in fluid communication with the main cooling chamber and which are disposed spaced from one another at equidistant points about the circumference of the cylinder liner. In addition, the secondary cooling chamber includes four outlet ports providing fluid communication with the outlet port of the main cooling chamber. The four outlet ports of the secondary cooling chamber are disposed spaced from one another at equidistant points about the circumference of the cylinder liner and between adjacent ones of the inlet ports. Furthermore, the secondary cooling chamber is defined by eight discrete segments extending between the four inlet ports and the four outlet ports such that fluid coolant is circulated from each of the four inlet ports in opposite directions through adjacent segments of the secondary cooling chambers toward a pair of the four outlets.

One advantage of the internal combustion engine having a cylinder liner cooling chamber of the present invention is that the mass flow of coolant within the cooling chamber is increased. Another advantage of the internal combustion engine having the cylinder liner cooling chamber of the present invention is that the resident time of the fluid within the eight discrete segments of the secondary cooling chamber is reduced relative to that of the related art. This results in a lower coolant temperature and, concomitantly, a lower liner temperature when compared with other designs known in the related art employing the same mass flow rate. Thus, the cylinder liner of the present invention is significantly less sensitive to variations in the coolant mass flow rate and the coolant fluid can absorb more thermal loading before boiling. The internal combustion engine employing the cylinder liner having cooling chambers of the present invention achieves these advantages while at the same time enjoying a relatively low pressure drop between the inlet to the secondary cooling chamber and the outlet to the main cooling chamber.

The engine block having the secondary cooling chamber of the present invention provides a uniform, high velocity stream of coolant fluid all around the upper margin of the cylinder liner which effectively cools the area of the liner adjacent to the top piston ring reversal point. This, in turn, tends to better preserve the critical lubricating oil film on the liner inside surface. A resulting uniform cooling also minimizes the liner bore distortion, leading to longer service life. Thus, the engine block having the secondary cooling chamber of the present invention provides optimum heat removal characteristics at both the gas or combustion side of the cylinder wall, which reduces oil deterioration, excessive wear and the like, as well as at the coolant side of the cylinder wall, which reduces coolant boiling.

Finally, the engine block employing the secondary cooling chamber of the present invention may be easily adapted to fit heavy duty classes of diesel engines ranging from a cylinder bore diameter and displacement of about 130 mm and about 1.8 liters/cylinder, respectfully (approximately 40 hp/cylinder) to a bore diameter and displacement of about 165 mm and about 4.1 liters/cylinder, respectively (approximately 225 hp/cylinder).

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
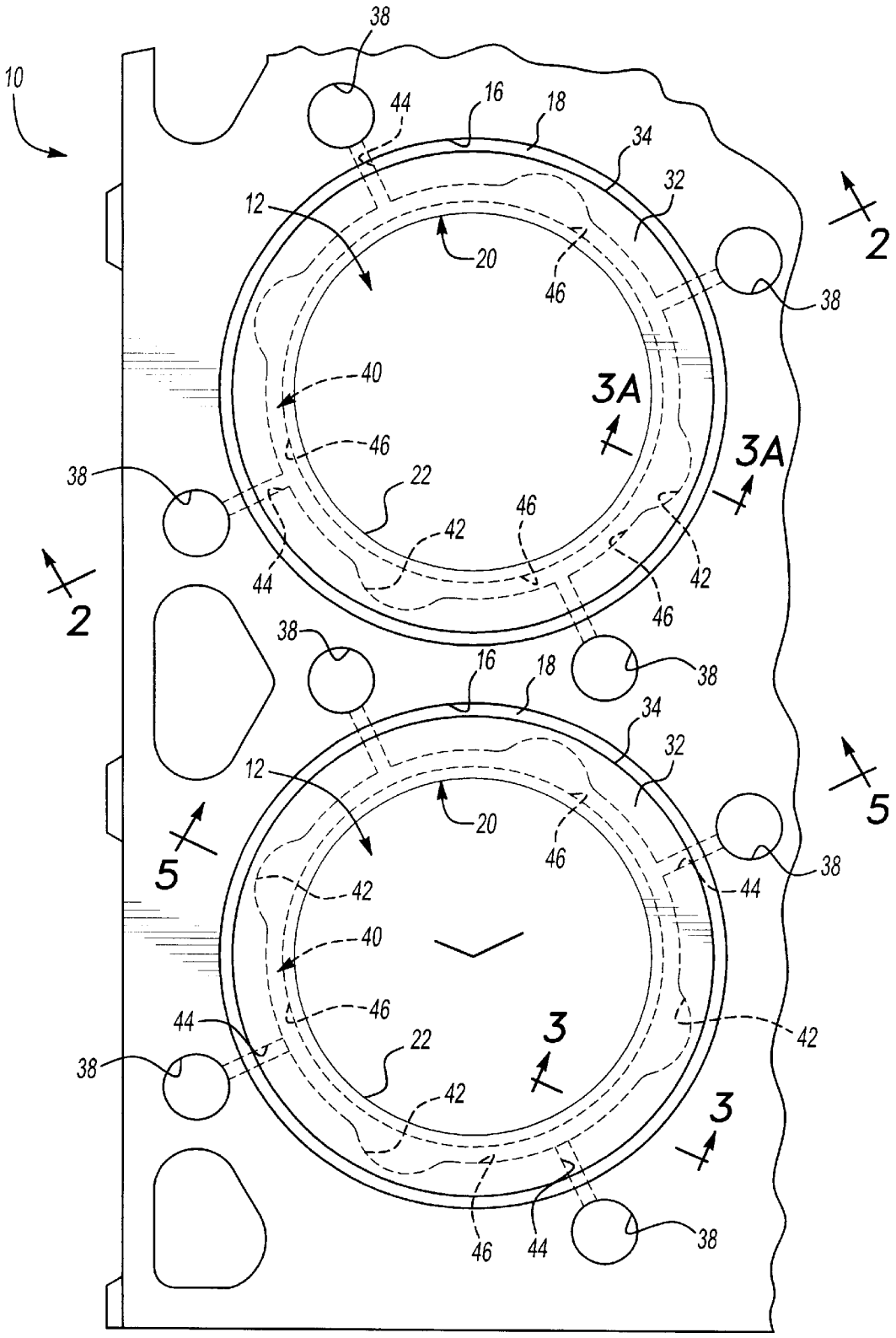
FIG. 1 is a partial plan view of the cylinder block having a plurality of cylinder bores and a cylinder liner constructed in accordance with the present invention.

One preferred embodiment of the cylinder block for an internal combustion engine of the present invention is generally indicated at 10 in FIGS. 1–5 where like numerals are used to designate like structures . The cylinder block 10 includes at least one, but preferably a plurality of, successively aligned cylinder bores generally indicated at 12. As best shown in the cross-sectional view of FIG. 2, each cylinder bore 12 includes a main, inner radial wall 14 having a first, smaller diameter and an upper wall 16 having a second, greater diameter. An annular shoulder 18 is defined between the inner radial wall 14 and the upper wall 16. A cylinder liner generally indicated at 20 is concentrically received within each cylinder bore 12. The cylinder liner 20 includes a radial inner wall surface 22 having a uniform diameter within which is received a piston, generally indicated at 24 in FIG. 5. The piston 24 includes the usual piston rings 26 and is of the type generally disclosed in U.S. Pat. No. 3,865,087 which is assigned to the assignee of the present invention and incorporated herein by reference. Together, the piston 24 and the inner wall surface 22 of the cylinder liner 20 define a combustion chamber within which fuel is combusted to power the piston in reciprocal motion and drive other components of the engine, as commonly known in the art.

The cylinder liner 20 also includes a main body portion 28 and an upper margin 30. A top flange 32 extends radially outwardly relative to the upper margin 30 of the cylinder liner 20 so as to define a stop shoulder 34. The stop shoulder 34 is cooperatively received in abutting relation by the annular shoulder 18 defined by the cylinder bore 12. Furthermore, the upper margin 30 of the cylinder liner 20 is dimensioned so as to form a close interference fit (i.e. 0.0005 to 0.0015 inch clearance) with the cylinder bore 12. The cylinder liner 12 is secured in place by the cylinder head and head bolt clamp load in a conventional manner.

Figure 2:
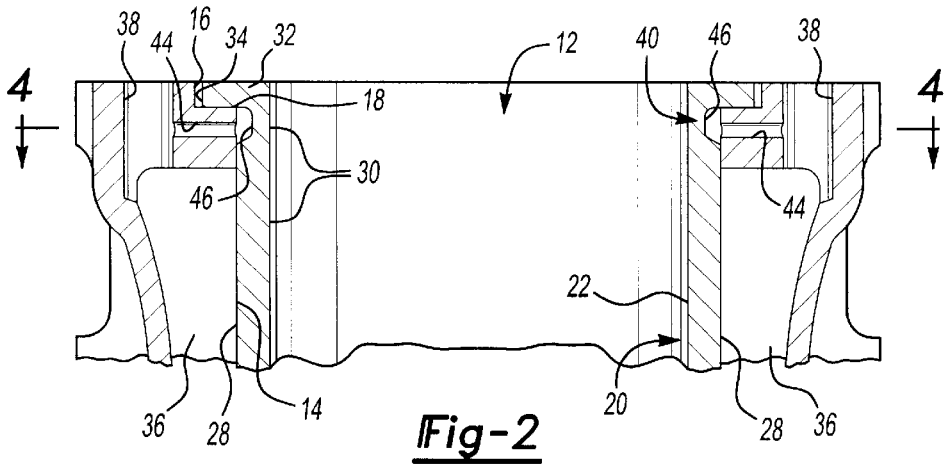
FIG. 2 is a partial cross-sectional side view taken substantially along lines 2—2 of FIG. 1.

As illustrated in phantom lines in FIG. 2, a main cooling chamber 36 surrounds a substantial portion of the main body portion 28 of the cylinder liner 12. To this end, the main cooling chamber 36 is preferably formed in the cylinder block 10 and between the block 10 and the main body portion 28 of the cylinder liner 20. The main cooling chamber 36 includes at least one inlet port in fluid communication with a source of pressurized engine coolant (not shown) and at least one outlet port 38. However, in the preferred embodiment illustrated in the figures, the main cooling chamber 36 has four outlet ports 38 for circulating the fluid engine coolant about the main body portion 28 of the cylinder liner 20 as will be described in greater detail below.

Figure 3:
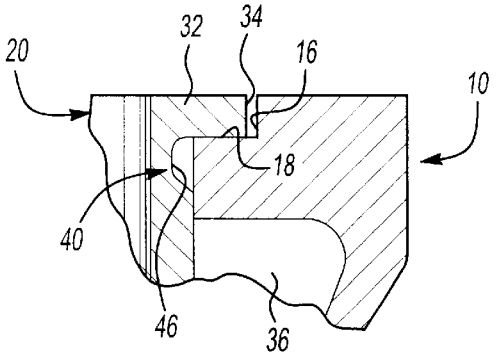
FIG. 3 is a partial cross-sectional side view taken substantially along lines 3—3 of FIG. 1.
Figure 3A:
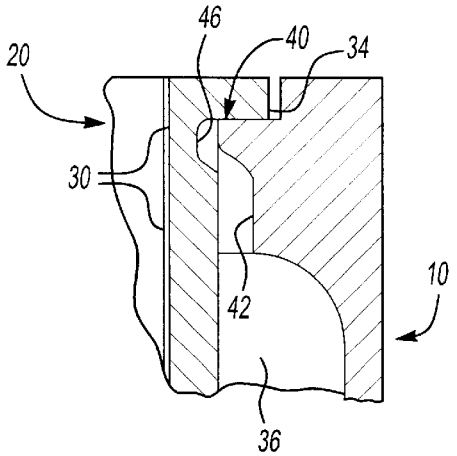
FIG. 3A is a partial cross-sectional side view taken substantially along lines 3A—3A of FIG. 1.
Figure 4:
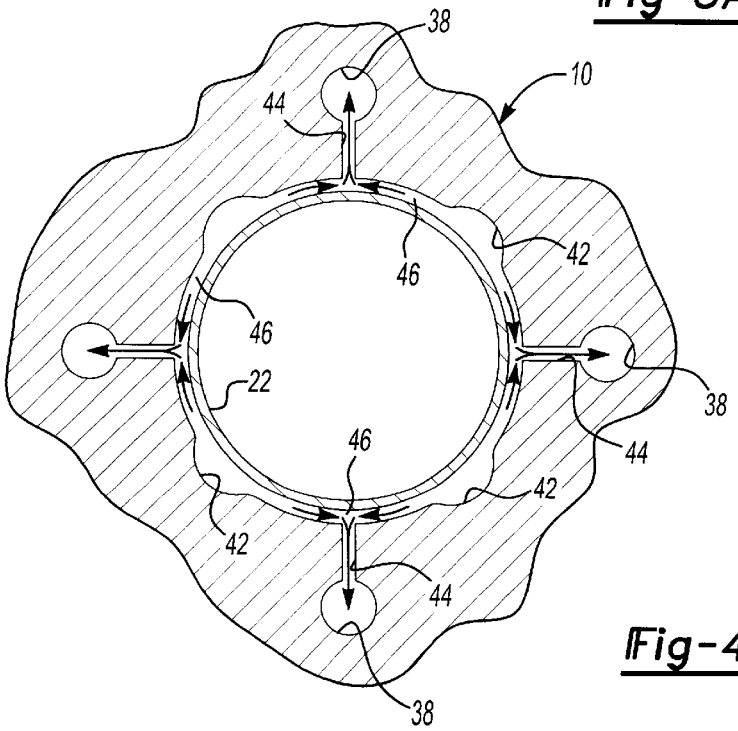
FIG. 4 is a partial cross-sectional top view taken substantially along lines 4—4 of FIG. 2.

As best shown in FIGS. 2–4, a secondary cooling chamber, generally indicated at 40, is located about the circumference of the upper margin 30 of the cylinder liner 20. Further, the secondary cooling chamber 40 extends for an axial length corresponding substantially to the axial length of the upper margin 30. In the preferred embodiment illustrated in these figures, the secondary cooling chamber 40 has four inlet ports 42 in fluid communication with the main cooling chamber 36. The inlet ports 42 are in the form of scalloped recesses constructed within the radial inner wall of the cylinder block 10. As best shown in FIG. 3A, each scalloped recess of the inlet ports 42 extend in axial length from a point opening to the main coolant chamber 36 to a point within the axial extent or length of the secondary cooling chamber 40. Furthermore, and as best shown in FIG. 4, the four inlet ports 42 are disposed space from one another at equidistant points about the circumference of the cylinder liner 20.

The secondary cooling chamber 40 also includes four outlet ports 44 providing fluid communication with the outlet ports 38 of the main cooling chamber 36. The four outlet ports 44 of the secondary cooling chamber 40 define radially extending annular passages disposed space from one another at equidistant points about the circumference of the cylinder liner 20 and between adjacent ones of the inlet ports 42. More specifically, and as illustrated in the preferred embodiments shown in these figures, the outlet ports 44 of the secondary cooling chamber 40 are spaced approximately 90 degrees from an adjacent outlet port 44 about the circumference of the cylinder liner 20. Similarly, the inlet ports 42 are space approximately 90 degrees from an adjacent inlet port 42 about the circumference of the cylinder liner 20.

Figure 5:
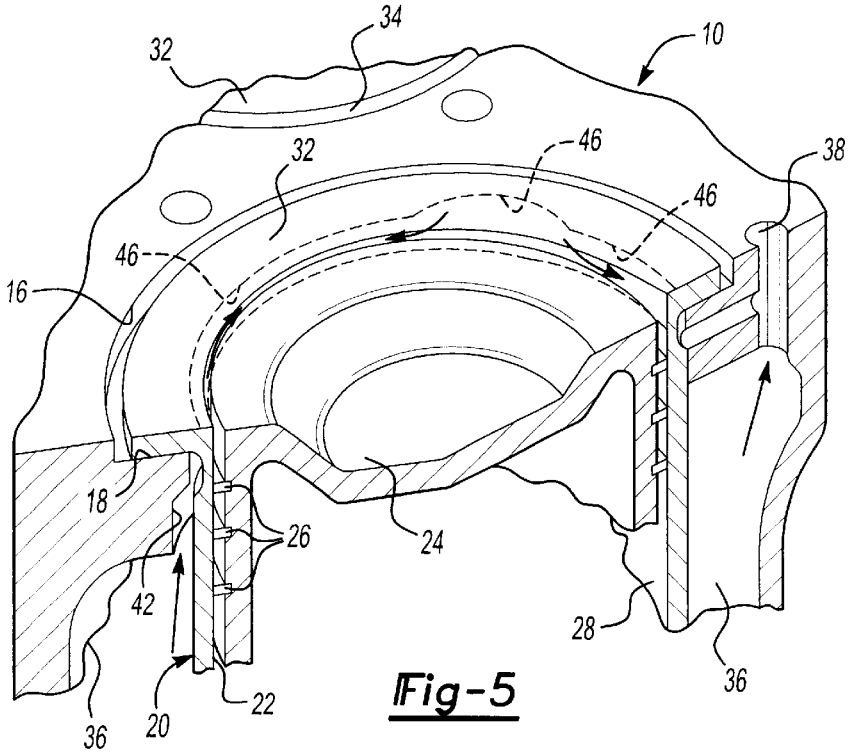
FIG. 5 is a partial cross-sectional perspective view taken substantially along lines 5—5 of FIG. 1.
Figure 6:
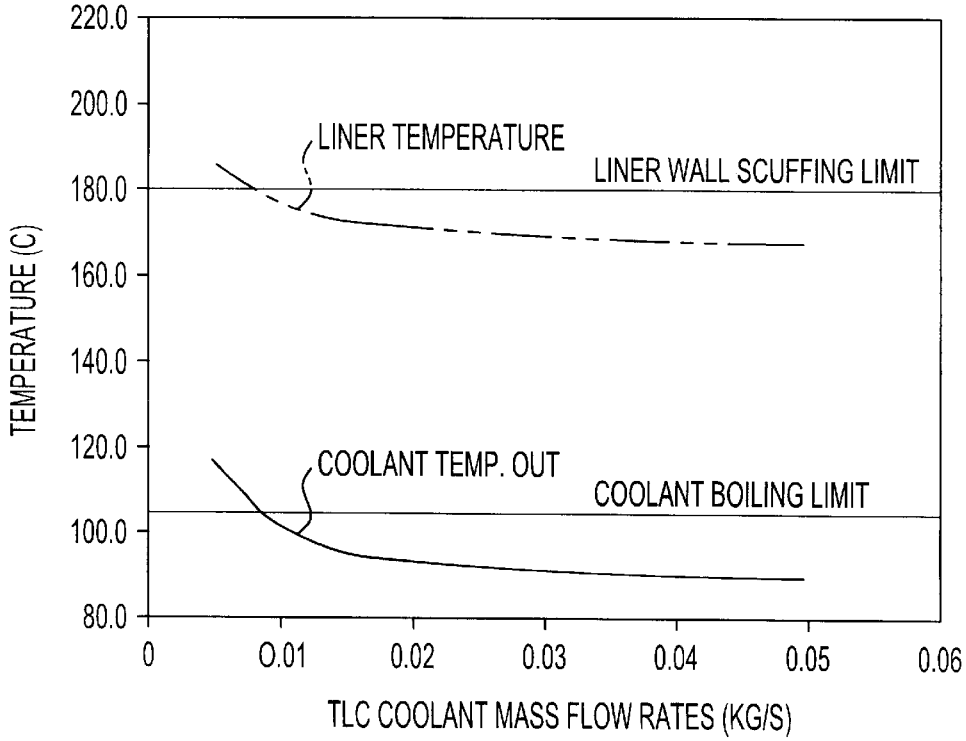
FIG. 6 is a graph of temperature versus coolant mass flow rates and illustrates the effect of cylinder liner coolant flow rates on temperatures.
Figure 7:
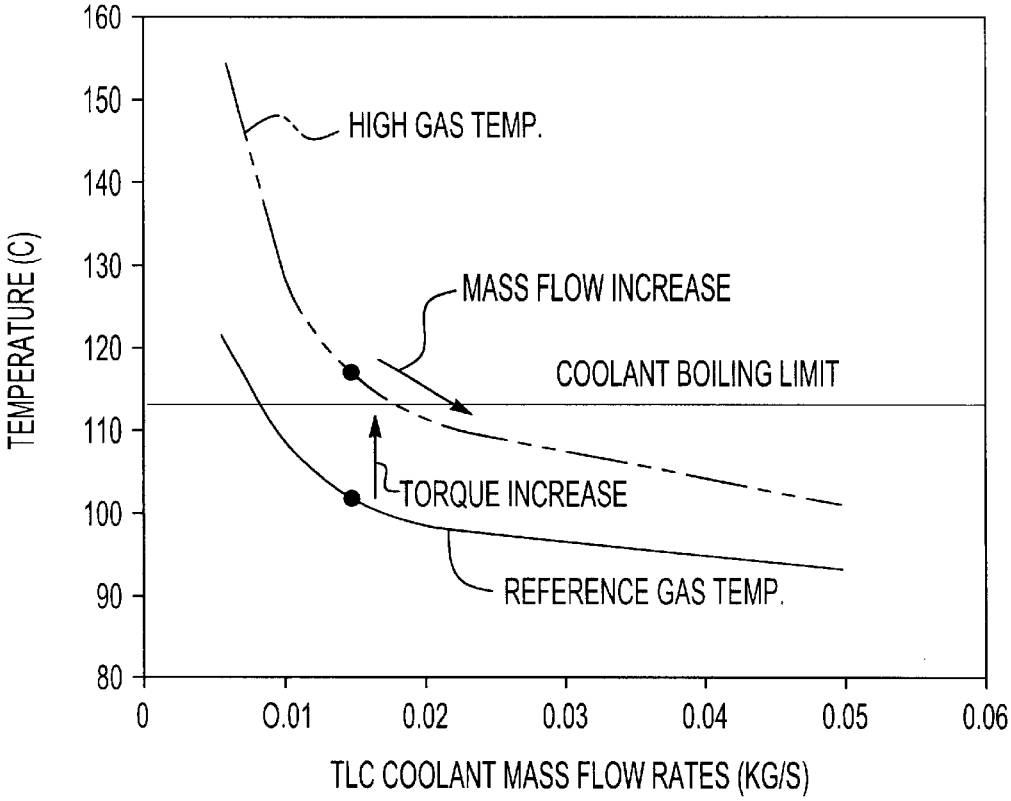
FIG. 7 is a graph of temperature versus coolant mass flow rates and illustrates the effect of the coolant flow rate and gas temperature at known gas temperatures and projected, higher gas temperatures.

The secondary cooling chamber 40 is further defined by eight, discreet segments 46 extending between the four inlet ports 42 and the four outlet ports 44 such that fluid coolant is circulated from each of the four inlet ports 42 in opposite directions through adjacent segments 46 of the secondary cooling chamber 40 toward a pair of the four outlets 44 as indicated by the arrows in FIGS. 4 and 5. Thus, in the preferred embodiment disclosed herein, the inlet ports 42 are spaced approximately 45 degrees from an adjacent outlet port 44. In each case, at least one of the eight segments 46 of the secondary cooling chamber 40 extends between an adjacent inlet and outlet port 42, 44 respectively and about a portion of the circumference of the cylinder liner 40. As best shown in FIG. 5, the secondary cooling chamber 40 is located so as to be adjacent the top piston ring reversal point when the piston assembly is at its point of zero velocity.

In operation, as coolant fluid is circulated through the main cooling chamber 36, it will exit the outlet ports 38 of the main cooling chamber 36 at a relatively high fluid velocity. For example, within the main cooling chamber 36, the fluid velocity may be less than one foot per second because of the volume of the fluid relative to the outlet ports 38 of the main cooling chamber. However, at each outlet port 38, the fluid velocity may be in the order of seven to eight feet per second and is an area of high fluid velocity relative to other areas of coolant flow. But for the existence of the secondary cooling chamber 40, the flow of coolant through the main cooling chamber 36 would not be uniform about the entire circumference of the cylinder liner 20. Rather, at various points about the circumference, and in particular with respect to the cooling schemes having two more outlets of the type taught in the related art, a region or zone of coolant flow stagnation forms at a point approximately 90 degrees, or half-way between, each of the two outlet ports. This creates hot spots with the potential for undesirable distortion and possible loss of lubricating oil film. These conditions may lead to premature wear and blow-by, especially at the higher operating temperatures and conditions envisioned for modem engines.

However, and pursuant to the secondary cooling chamber 40 of the present invention, coolant fluid from the main cooling chamber 36 is caused to be drawn through each of the scalloped recesses of the four secondary cooling chamber inlet ports 42. The coolant fluid is then split in equal flow paths to each of the respective outlet ports 44 of the secondary cooling chamber located approximately 45 degrees from the adjacent inlet port 42. From these outlet ports 44, the coolant passes out the main cooling chamber outlet ports 38 under the influence of a venturi effect. This venturi effect is created by reason of the Bernoulli relationship between the fluid velocity and pressure in the respective ports 38, 44. More specifically, the high velocity flow of the main coolant stream through each outlet port 38 provides a reduced pressure head at the intersection with the radial outlet port 44 of the secondary cooling chamber 40. Thus, the coolant within the eight discreet segments 46 will be at a substantially higher pressure head than that which exists within the radially extending outlet ports 44 of the secondary cooling chamber, thereby inducing flow at a relatively high fluid velocity through the segments 46. It is estimated that the fluid velocity through the discreet segments 46 will be, for example, at least about three, and perhaps as much as six feet per second. Thus, the present invention provides a very efficient means for removing a significant portion of the thermal energy per unit area of the cylinder liner 20 at the upper margin 30 of the cylinder liner which is adjacent to the combustion chamber.

The diameter of the radially directed outlet ports 44 of the secondary cooling chamber 40 are sized relative to that of the outlet ports 38 of the main cooling chamber 36 so as to form, in effect, the venturi. Generally, however, the axial and radial length of the inlet and outlet ports 42, 44, respectively, of the secondary cooling chamber 40 are selected based on the object of maintaining the flow area through these ports equal with the flow through the eight discreet segments 46. Thus, in the embodiment illustrated in FIGS. 1–5, the flow area through each inlet and outlet port 42, 44, respectively is twice that of any given discreet segment 46.

The length of any give discrete segment 46 is determined by the bore size and the equidistant location of inlet and outlet ports 44 and 42. The diameters of the inlet and outlet ports 42, 44, as well as the discrete segments 46 are, however, generally as large as possible to minimize pressure losses and allow the maximum flow. Passage size (diameter) is generally limited by structural strength of the block and liner in this area. Finite Element Analysis (FEA) is used to determine maximum passage size.

The diameter of the outlet ports 38 is used to control the amount of flow passing through the secondary cooling chamber 40 relative to the main cooling chamber 36. In the case of desiring a large percentage of total flow to go through the secondary cooling chamber 40 (for example, 40% of total) the lower portion of the outlet port 38 may include a predetermined small diameter, while the upper half of the outlet port 38 may include a predetermined larger diameter. The small diameter of the lower portion of the outlet port 38 restricts the flow from main cooling chamber 36 to the outlet port 38, forcing the flow through the secondary cooling chamber 40 and out outlet port 44 to the upper, unrestricted portions of the outlet port 38. For small values of the diameter of the lower portion of the outlet port 38, the venturi effect between the discrete segments 46 and the upper portion of the outlet ports 38 vanishes. Thus, the diameter of the lower portion of outlet ports 38 (below the intersection with passage outlet port 44) becomes the controlling factor determining the flow ratio between the main and secondary cooling chambers 36, 40, respectively.

Figure 8:
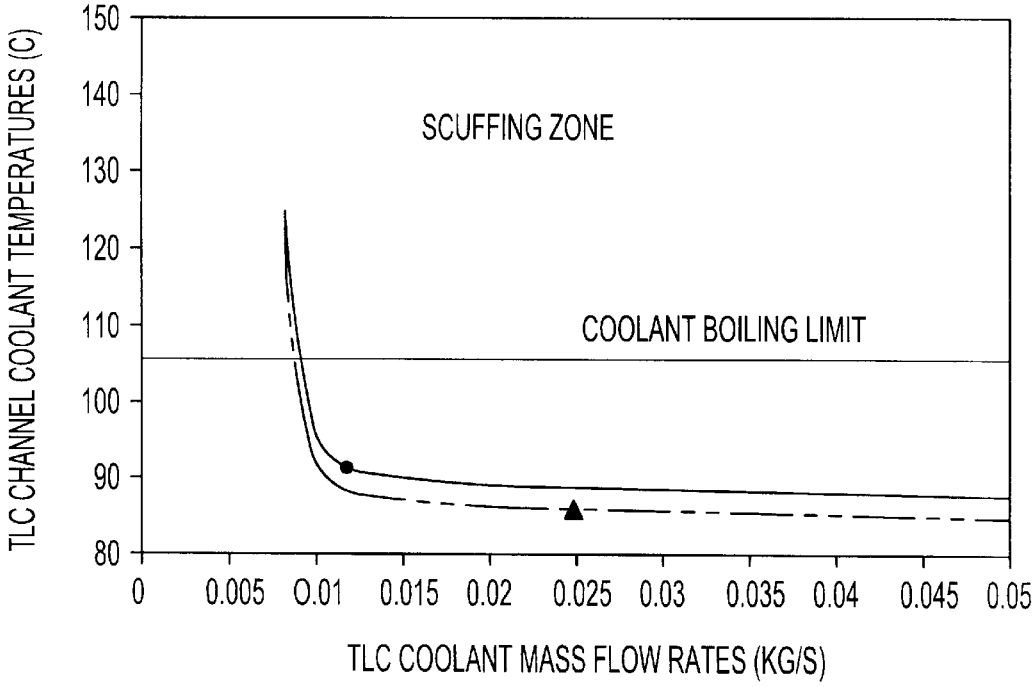
FIG. 8 is a graph of the coolant temperatures in the cooling chambers versus the coolant mass flow rates illustrating the operating curves for presently known cooling chamber designs (b) versus the cooling chamber design of the present invention (a).

An operating curve for an internal combustion engine with an engine block having the main and secondary cooling chambers 36, 40 of the present invention is illustrated in FIG. 8. As noted in that figure, the operating curve (A) for the present invention is lower than the operating curve (B) of an internal combustion engine employing the cooling chambers of the related art because of the reduced resident titne of the fluid in the eight discreet segments 46. With the points shown, it can be easily seen from the plot that point B is near the cusp of the operating curve. Thus, small decreases in flow can have large increases in temperature, whereas similar variations in flow will have no effect on temperature for point A because it is on a flat section of the operating curve. Thus, the lowered operating curve indicates a lower coolant/liner temperature for engines employing the present invention than for other designs presently known in the related art using the same mass flow rate of a coolant. Furthermore, and because the operating point of the internal combustion engine of the present invention is further to the right, as illustrated in FIG. 8, than those known in the related art, it is significantly less sensitive to variations in flow, and can absorb more thermal loading before the fluid coolant is induced to boil.

Thus, the engine block having the secondary cooling chamber 40 of the present invention provides optimum heat removal characteristics at both the gas or combustion side of the cylinder wall, which reduces oil deterioration, excessive wear and the like, as well as at the coolant side of the cylinder wall, which reduces coolant boiling. Finally, the engine block 10 employing the secondary cooling chamber 40 of the present invention may be easily adapted to fit heavy duty classes of diesel engines ranging from a cylinder bore diameter and displacement of about 130 mm and about 1.8 L/cylinder, respectively (approximately 4 hp/cylinder) to a bore diameter and displacement of about 165 mm and about 4.1 L/cylinder, respectively (approximately 225 hp/cylinder).

Finally, while the description of the preferred embodiment set forth above has made particular reference to diesel engines, the present invention is not dependant upon what fuels the engine, but rather is applicable to any liquid-cooled internal combustion engine wherein substantial heat must be removed at the upper margins of the combustion cylinder liner, or its equivalent.

The present invention has been described in an illustrative manner. It is to be understood that the terminology which has been used is intended to be in the nature of words of description rather than of limitation. Those having ordinary skill in the art will readily appreciate that many modifications and variations of the present invention are possible in light of the above teachings. Therefore, within the scope of the appended claims, the present invention may be practiced other than as specifically described.

I claim:

1. An internal combustion engine including a cylinder block having at least one cylinder bore, said internal combustion engine comprising:

a cylinder liner concentrically disposed within said cylinder bore and secured to said cylinder block, said cylinder liner including a main body portion and an upper margin;

a main cooling chamber surrounding a substantial portion of the main body portion of said cylinder liner and having an inlet port and at least one outlet port for circulating a coolant fluid about said main body portion of said cylinder liner;

a secondary cooling chamber located about the circumference of said upper margin of said cylinder liner, said secondary cooling chamber having four inlet ports in fluid communication with said main cooling chamber and disposed spaced from one another at equidistant points about the circumference of said cylinder liner and four outlet ports providing fluid communication with said outlet port of said main cooling chamber, said four outlet ports disposed spaced from one another at equidistant points about the circumference of said cylinder liner and between adjacent ones of said inlet ports;

said secondary cooling chamber being defined by eight discrete segments extending between said four inlet ports and said four outlet ports such that fluid coolant is circulated from each of said four inlet ports in opposite directions through adjacent segments of said secondary cooling chamber toward a pair of said four outlets.

2. An internal combustion engine as set forth in claim 1 wherein each of said outlet ports is spaced approximately 90° from an adjacent outlet port about the circumference of said cylinder liner.

3. An internal combustion engine as set forth in claim 1 wherein each of said inlet ports is spaced approximately 90° from an adjacent inlet port about the circumference of said cylinder liner.

4. An internal combustion engine as set forth in claim 1 wherein each of said inlet ports is spaced approximately 45° from an adjacent outlet port with at least one of said eight segments of said secondary cooling chamber extending there between about a portion of the circumference of said cylinder liner.

5. An internal combustion engine as set forth in claim 1, wherein at least one of said secondary coolant chamber outlet port has an upper diameter and a lower diameter; said lower diameter being smaller then said upper diameter to control the coolant flow of the secondary coolant chamber relative to said first coolant chamber.

* * * * *